US006591529B1

(12) United States Patent
Lane

(10) Patent No.: US 6,591,529 B1
(45) Date of Patent: Jul. 15, 2003

(54) SUPPORT STRUCTURE FOR DECORATIVE MOBILE

(76) Inventor: Laurie S. Lane, 10024 Grant Creek Rd., Missoula, MT (US) 59808

( * ) Notice: Subject to any disclaimer, the term of this patent is extended or adjusted under 35 U.S.C. 154(b) by 0 days.

(21) Appl. No.: 09/676,973

(22) Filed: Sep. 27, 2000

(51) Int. Cl.[7] ..... G09F 7/22
(52) U.S. Cl. ..... 40/617; 446/227
(58) Field of Search ..... 40/617; 446/227; D21/467, 647

(56) References Cited

U.S. PATENT DOCUMENTS

| | | | | | |
|---|---|---|---|---|---|
| 3,564,759 | A | * | 2/1971 | Buttermore | 40/617 |
| 4,567,682 | A | * | 2/1986 | Hurxthal | 40/617 |
| D336,495 | S | * | 6/1993 | Raiffe et al. | D11/141 |
| D356,346 | S | * | 3/1995 | Yip | D21/63 |

* cited by examiner

*Primary Examiner*—Cassandra H. Davis
(74) *Attorney, Agent, or Firm*—Burkhart & Burkhart; Anne K. Burkhart; Patrick N. Burkhart

(57) ABSTRACT

A support assembly in a decorative structure includes at least two suspended elements. The support assembly includes a support tube having a hollow interior and opposed end portions. In an embodiment, a pair of selectively removable adjustment are adapted to interlock with a respective end portion of the support tube. A flexible, elongate support element is secured between each of the clips and the respective end portions of the support tube. The elongate support element has two ends, each of the ends being adapted for attachment to a suspended element of the decorative structure. The adjustment clips can be adapted to fit over the end portions of the support tube, which can be constructed as a hollow cylindrical tube. In an illustrated embodiment, the adjustment clips comprise annular cylindrical members having an inner diameter approximately equal to an outer diameter of the support tube. In another embodiment, the elongate support element is secured in slits on the respective ends of the support tube. The elongate support element can be provided as a string, for example, monofilament. The support tube and/or the adjustment clips can be fabricated from a transparent material. The support tube can be provided with a substantially arcuate shape. A method of securing suspended elements to a support assembly in a decorative structure including at least two suspended elements is also set forth.

11 Claims, 3 Drawing Sheets

SUPPORT STRUCTURE FOR DECORATIVE MOBILE

FIELD OF THE INVENTION

The present invention relates generally to support structures for decorative mobiles. Specifically, the present invention relates to support structure for decorative mobiles that provides adjustability and simplicity of construction.

BACKGROUND OF THE INVENTION

Whether they involve sheep and angels entertaining infants from high above a crib, or Calder's kinetic sculpture entertaining millions as high art, mobiles are universally valued for their beauty and proportion. Mobiles typically include decorative elements suspended from interconnected linear, generally horizontal support members. The decorative elements are usually suspended from the support members by relatively thin structures such as rods, cables, string, or cord.

Support structure contributes significantly to the overall effect of mobiles. Aesthetically, the support structure must be proportional to the overall piece. The support structure provides visual balance to the decorative elements, and must be of suitable length and thickness so as to complement rather than overpower the decorative elements. Physically, the support structure must have sufficient strength to securely hold the decorative elements in position, and properly interconnected to balance the various decorative elements for relative movement.

Various support structures for mobiles have been proposed, and some of these are represented in the patent literature. For example, U.S. Pat. No. 5,606,816 to Schwartz is directed to a mobile that is constructed from modular components. The mobile is particularly suited for displaying pictures (i.e. photographs) and updating pictures from time to time. The modular components include display envelopes, a modular support, a hanger, and a suspension medium (i.e. thread). Each of the display envelopes are capable of simultaneously displaying two pictures. The display envelopes are suspended from the modular support via the suspension medium. The hanger is centrally located along the length of the modular support and facilitates hanging the modular support and the associated display envelopes from an external structure. The modular support and interconnected display envelopes are optimally balanced by the alignment of the hanger. In particular, the modular support and the associated display envelopes are balanced by longitudinally sliding the hanger along the modular support.

Another example is U.S. Pat. No. 3,762,084 to Jones, in which an ornamental mobile is suspended by a single thin wire from a support, the mobile being comprised of a pair of horizontal crossing arms secured at the junction to the depending wire, each of the crossing arms at their outer ends supporting individual arms on depending wires there from which support fish shaped figures which are made of braided ribbons of various colors, the ends of the ribbons forming fins, and a button being secured to each side of the fish like figure so to represent eyes.

U.S. Pat. No. 4,578,888 to Gomez is directed to a fish mobile structure adapted to be displayed in a windy environment, such as near an open window or in a patio area, or the like. The mobile includes a plurality of segmented portions collectively forming a fish body structure, each of the segmented portions being joined in spaced-apart relationships to one another by a plurality of strings, a plurality of fin structures secured to portions of the fish body structure by means of strings and disposed in spaced-apart relationship thereto, and weights secured to the segmented portions to maintain the fish body structure in a vertical arrangement and to draw the strings taut to allow and encourage pivotal movement of the various string-joined together portions of the mobile when such are moved by wind currents flowing thereabout.

U.S. Pat. No. 4,567,682 Hurxthal discusses a mobile in which pairs of photographs or the like are suspended in mid-air from a horizontally disposed elongated support member or rod located above the pairs of photographs, by means of a suspension means interconnected with the upper disposed support member and a clamping means, clamping and holding the pair of photographs. Elongated support members can be joined together end-to-end, using a connecting sleeve.

While each of these examples of known mobile support structures has its advantages, known systems fail to provide a simple, inexpensive, yet effective support structure that is also aesthically pleasing.

SUMMARY OF THE INVENTION

These and other objects are achieved by providing a support assembly in a decorative structure including at least two suspended elements. The support assembly includes a support tube having a hollow interior and opposed end portions. A pair of selectively removable adjustment clips, each of the clips being adapted to interlock with a respective end portion of the support tube, are also provided. A flexible, elongate support element is secured between each of the clips and the respective end portions of the support tube. The elongate support element has two ends, each of the ends being adapted for attachment to a suspended element of the decorative structure. Alternatively, the support element can be secured in slits in the end of the support tube.

The adjustment clips can be adapted to fit over the end portions of the support tube, which can be constructed as a hollow cylindrical tube. In an illustrated embodiment, the adjustment clips comprise annular cylindrical members having an inner diameter approximately equal to an outer diameter of the support tube. The elongate support element can be provided as a string, for example, monofilament. The support tube and/or the adjustment clips can be fabricated from a transparent material. The support tube can be provided with a substantially arcuate shape.

A method of securing suspended elements to a support assembly in a decorative structure including at least two suspended elements is also set forth. First, a support tube having a hollow interior and opposed end portions is provided, along with a pair of selectively removable adjustment clips. Each of the clips is adapted to interlock with a respective end portion of the support tube. A flexible, elongate support element is secured between each of the clips and the respective end portions of the support tube The elongate support element has two ends, each of which is adapted for attachment to a suspended element of the decorative structure. The elongate support element is threaded through the support tube. Next, a suspended element is attached to each of the each of the ends of the elongate support element. The adjustment clips are then placed in interlocking relation with the respective end portions of the support tube.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE INVENTION

Figure 1:
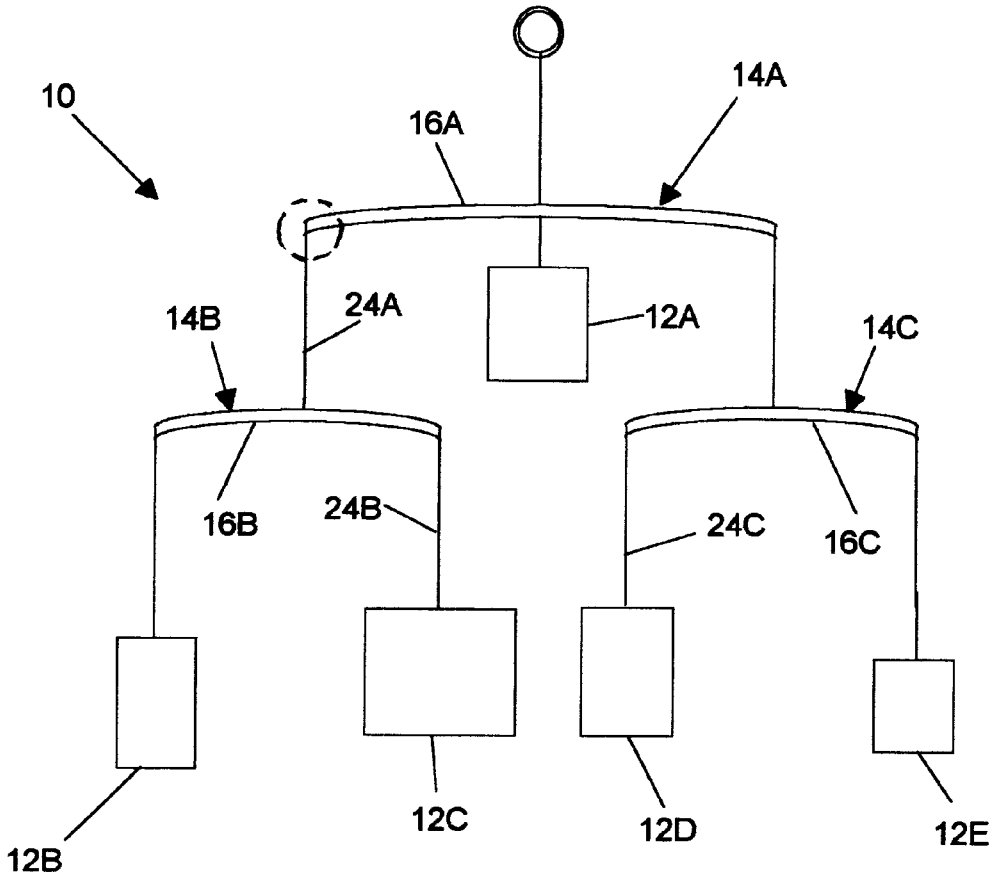
FIG. 1 is a schematic illustration of a decorative structure in accordance with the principles discussed herein.

A decorative structure, here shown as a mobile 10 in accordance with the principles of the present invention, is illustrated in FIG. 1. The mobile 10 includes a plurality of suspended elements 12A through 12E. The suspended elements hang downwardly from support assemblies 14A, 14B, and 14C.

Figure 2:
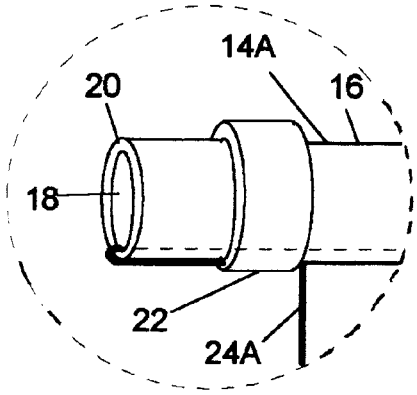
FIG. 2 is a detailed view of a portion of a support assembly.

As seen in the FIG. 2 detail of support assembly 14A, each of the support assemblies includes a support tube 16 having a hollow interior 18 and opposed end portions 20. The support tube 16 can be constructed from any suitably rigid and aesthetically appropriate material such as wood, metal, glass, or plastic. It has been found that a transparent plastic material, such as polycarbonate or LEXAN can be employed to good effect.

In the FIG. 2 embodiment, securing elements in the form of a pair of selectively removable adjustment clips 22 are adapted to interlock with the end portions 20 of the support tube 16. The adjustment clips 22 can be provided as annular bands having internal diameters substantially equal to, or slightly larger than, the outer diameters of the support tubes 16 to which they are secured. The adjustment clips 22 can be fabricated from any suitable material, and should complement the material of the support tubes 16. It has been found that clear flexible materials, such as HDPE, work well with transparent support tubes.

Flexible, elongate support elements 24A, 24B, and 24C are secured between each of the clips 22 and the respective end portions 20 of the support tubes 16. The elongate support element 24 has two ends, each of the ends being adapted for attachment to a suspended element 12A–12E of the decorative structure 10. The elongate support elements 24 can be provided as any suitable wire, rod, fiber, or string-like material. With transparent support structures, it has been found that transparent monofilament, such as nylon monofilament, is particularly suitable.

Figure 3:
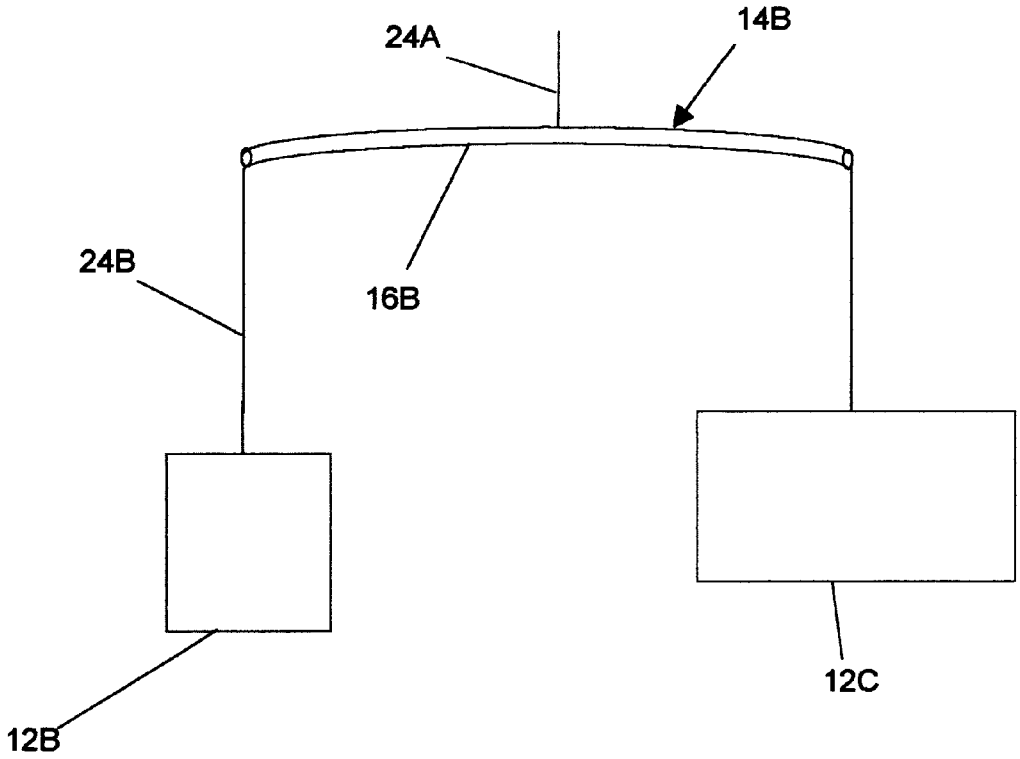
FIG. 3 is a schematic illustration of a partial support assembly.
Figure 4:
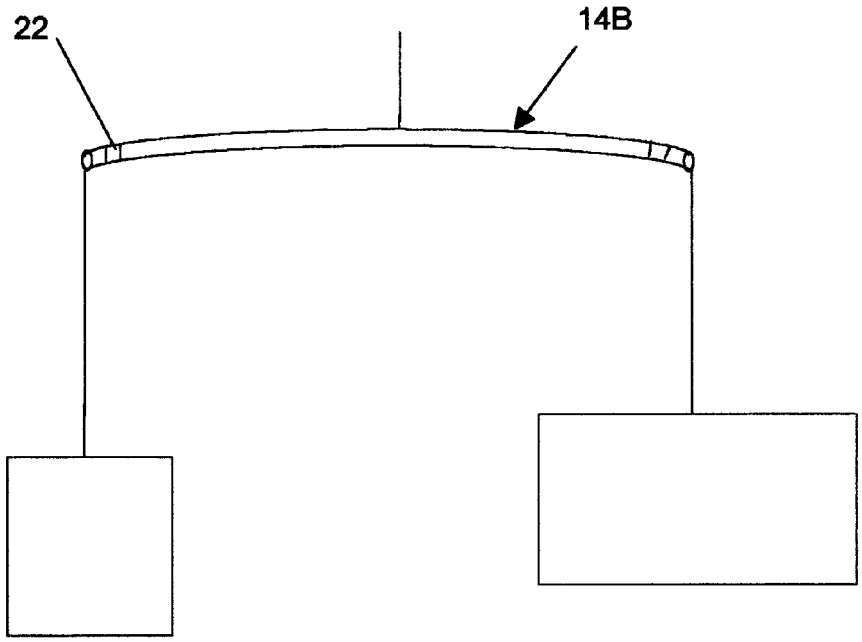
FIG. 4 is a schematic illustration of a support assembly in a completed state of assembly.

A method of securing suspended elements to a support assembly in a decorative structure is illustrated in FIGS. 3 and 4. The elongate support element 24B has been threaded through the support tube 16B. The decorative elements 12B and 12C have been secured to opposite ends of the elongate support element 24B, and then positioned by sliding the elongate support element 24B within the support tube 16B until the desired balance has been achieved. Next, the adjustment clips 22 are placed in interlocking relation with the support tube 16B by being slid over the ends of the support tube 16B, securing the elongate support element 24B between the inner diameters of the clips 22 and the outer diameters of the support tubes 16.

Figure 5:
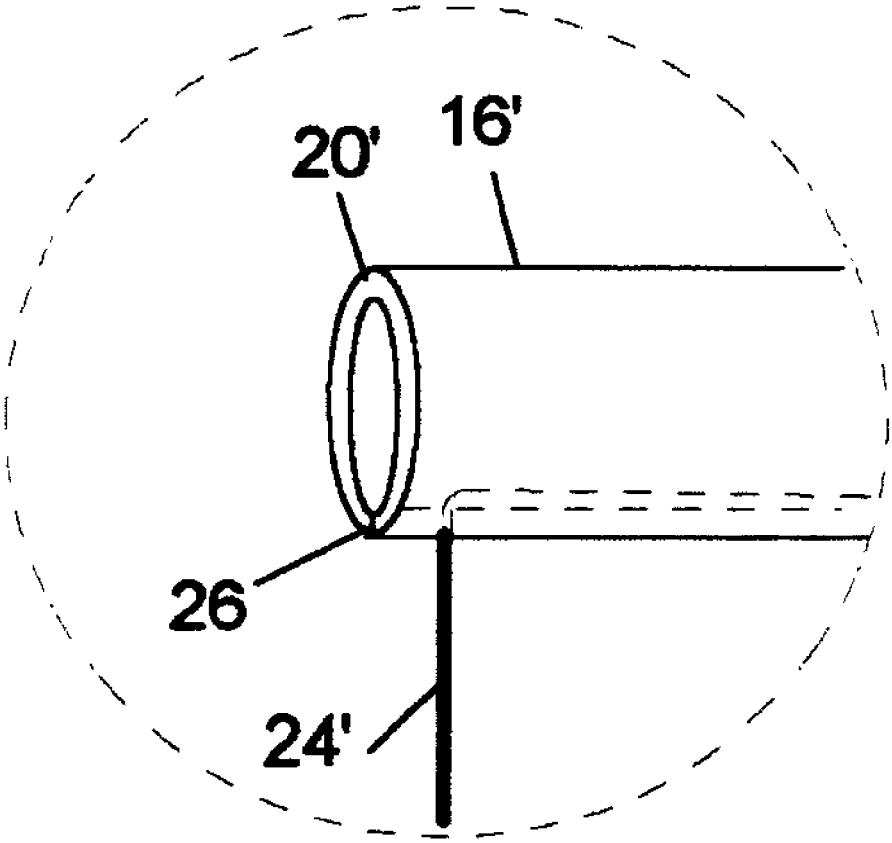
FIG. 5 is a detailed view of a portion of a support assembly.

An alternative arrangement for securing elements is shown in FIG. 5, in which opposed end portions 20' of a support tube 16' is provided with a slit 26 at a bottom portion thereof. The elongate support element is then inserted into the slit 26 when the decorative elements are balanced.

The present invention affords a type and degree of adjustability unknown in the prior art. This is particularly important where the decorative elements of the mobile are subject to frequent change, such as photographs in transparent sleeves, permitting the use of decorative elements in a wide range of sizes and weights.

Although the present invention has been described with reference to specific embodiments, those of skill in the art will recognize that changes may be made thereto without departing from the scope and spirit of the invention as defined by the appended claims. For example, the support tubes can be configured with a square or other polygonal cross-section. Similarly, the adjustment clips could be provided as plugs fitting into, rather than bands fitting over, the ends of the support tubes, or that the elongate support elements can be held in place by surface friction between the elongate support elements and the interior surfaces of the support tubes.

What is claimed is:

1. In a decorative structure including at least two suspended elements, a support assembly comprising the following:

a support tube having a hollow interior and opposed end portions;

a pair of securing elements, each of the securing elements including slits in the end portions of the support tube located on a respective end portion of the support tube; and a flexible, elongate support element secured to the respective end portions of the support tube by the securing elements, the elongate support, element having two ends, each of the ends being adapted for attachment to a suspended element of the decorative structure.

2. A support assembly according to claim 1, wherein the securing elements comprise adjustment clips adapted to fit over the end portions of the support tube.

3. A support assembly according to claim 2, wherein the support tube comprises a hollow cylindrical tube.

4. A support assembly according to claim 3, wherein the adjustment clips comprise annular cylindrical members having an inner diameter approximately equal to an outer diameter of the support tube.

5. A support assembly according to claim 2, wherein the support tube is fabricated from a transparent material.

6. A support assembly according to claim 5, wherein the adjustment clips are fabricated from a transparent material.

7. A support assembly according to claim 1, wherein the elongate support element is selected from a group comprising string and monofilament.

8. A support assembly according to claim 1, wherein the support tube is substantially arcuate.

9. In a decorative structure including at least two suspended elements, a method of securing suspended elements to a support assembly, the method comprising the following steps:

providing a support tube having a hollow interior and opposed end portions;

providing a pair of securing elements located on respective end portions of the support tube;

providing a flexible, elongate support element secured to the respective end portions of the support tube by the securing elements, the elongate support element having two ends, each of the ends being adapted for attachment to the suspended element of the decorative structure;

threading the elongate support element through the support tube;

attaching the suspended element to: each of the each of the ends of the elongate support element; and placing the support element in interlocking relation with the securing elements on the end portions of the support tube.

10. A method according to claim 9, wherein the step of placing the support element in interlocking relation comprises placing selectively removable adjustment clips over the end portions of the support tube.

11. A method according to claim 9, wherein the step of placing the support element in interlocking relation comprises placing the support element into slits in the end portions of the support tube.

* * * * *